United States Patent [19]

Hunter

[11] 4,135,676

[45] Jan. 23, 1979

[54] AUTOMATIC TENSIONING MECHANISM FOR A CONTINUOUS WEB

[75] Inventor: Alexander Hunter, Chalfont, Pa.

[73] Assignee: Transaction Management, Inc., Montgomeryville, Pa.

[21] Appl. No.: 828,851

[22] Filed: Aug. 29, 1977

[51] Int. Cl.[2] ..... B65H 17/02

[52] U.S. Cl. ..... 242/67.2; 242/67.3 R; 242/75.51

[58] Field of Search ..... 242/67.2, 67.3 R, 75, 242/75.3, 75.5, 75.51; 318/6

[56] References Cited

U.S. PATENT DOCUMENTS

| | | | |
|---|---|---|---|
| 3,019,999 | 2/1962 | Schiff | 242/75.51 |
| 3,721,398 | 3/1973 | Azzalin et al. | 242/67.3 R |
| 3,857,527 | 12/1974 | Kranz | 242/75.5 |

*Primary Examiner*—Leonard D. Christian
*Attorney, Agent, or Firm*—Robert J. Zinn

[57] ABSTRACT

A mechanism for taking up the slack in a continuous web being fed to the take up mechanism by independent control means. The take up mechanism is automatically switched on whenever feeding of the continuous web by the independent control means commences. The take up mechanism continues to operate as the continuous web is being fed by the independent control means. At such time as the feeding of the continuous web is terminated the automatic take up mechanism continues to take up slack in the paper web until the tension in the paper web precludes further rotation of the geared spindle upon which the continuous web is being wound. Because of the pivotal nature of the drive assembly, comprising a motor and drive gear, the motor continues to turn the drive gear causing the latter to "walk" over the now stationary driven gear and in so doing causes the housing of the motor to come into contact with and depress a microswitch thereby interrupting the flow of electricity to the drive motor. The operative forces are such that the motor housing continues to maintain the microswitch in a depressed condition until feeding of the continuous web is resumed.

3 Claims, 3 Drawing Figures

AUTOMATIC TENSIONING MECHANISM FOR A CONTINUOUS WEB

FIELD OF INVENTION

This invention relates broadly to automatic tensioning devices for use in conjunction with a continuous web and specifically to such devices as are adapted to function in conjunction with a feed system for independently feeding the continuous web from a supply roll through a work station. It is the function of the present invention to maintain an essentially constant tension in the continuous web after it leaves the work station and is retrieved by means of a take-up roll. Such automatic tensioning mechanisms are commonly employed as tension regulating devices in order to preclude undue slackness or tautness in a continuous web. It is the function of the present invention to provide an improved form of automatic tensioning mechanism having particular applicability to the maintenance of constant tension in a printed output tape from a transaction terminal.

BACKGROUND OF INVENTION

The present invention has particular applicability to the transaction terminal which is the subject of the copending application of Loren A. Schultz and Harrison J. Martell entitled Validating Transaction Terminal filed July 18, 1977 under Ser. No. 816,657.

Historically, transaction terminals evolved from the early cash registers. These were positioned within retail operations at the point of sale and provided the means for tallying individual purchases and for providing a consolidated listing of the items being purchased by a customer. The output of such devices often appeared in printed form on a paper tape, provision being sometimes made for internal storage of a duplicate copy of each transaction.

Transaction terminals constructed in accordance with the principles set out in the aforementioned Schultz et all patent application constitute a further significant improvement in the operating capability of such devices. The Schultz et al system is the first such system specifically designed to integrate the customer into the record keeping process of the transaction terminal. This is accomplished in part by providing means whereby the customer records his signature directly onto the output tape generated by the transaction terminal as part of each transaction customarily requiring it. Thus in connection with a credit sale or similar transaction, the customer's signature becomes a permanent part of each record stored within the transaction terminal.

The facility to record and retain the customer's signature as part of each record, for subsequent storage and/or processing through an associated computer, has obvious advantages. It reduces the cost of gathering and processing data, the amount of data collected and the probability of error occurring in the data. The provision of a single record, which not only records and itemized the elements of a transaction but which also embodies the customer's signature as a permanent part of the record constitutes a further important step in the evolution of transaction terminals, thereby advancing the state of the art from devices which serve a purely listing function to a device which incorporates into a single record all elements of a transaction thus in essence, effecting a complete recordation of a contractual relationship. In order to place this important improvement achieved by way of the Schultz et al system in proper perspective it has been demoninated as a validating transaction terminal.

Particular features of the Schultz et al terminal which enhance its use as a point of purchase device include the facility to provide a duplicate printed output statement of each transaction processed in the terminal. One copy of the printed output is available for the customer while the second copy is internally stored on a suitable take up mechanism. The stored tape thus serves as a record of all transactions processed through the terminal over a determinable period of time.

Since a substantial number of retail store transactions constitute a charge sale, the validating transfer feature of the Schultz et al terminal means the customer signature can be entered directly on to the printed output tape. Since the same information appearing on the customers receipt will also appear on the duplicate printed tape, to be stored internal to the system, it is necessary to insure that the plural tapes are conjunctively positioned as they leave the printer area and are advanced across the signature table where the validating action takes place. It is equally important that the customer's receipt be readily severable from the duplicate copy to be stored internal to the terminal.

It is in this connection that the present invention finds particular application in that it is necessary to insure that proper tension exists in the duplicate copy of the paper tape to be stored internal to the terminal so that the operator does not accidentially tear off the tape and remove it with the customer's receipt.

It is therefore an important object of the present invention to provide an automatic tensioning mechanism for use in conjunction with the take up roll of a validating transaction terminal whereby a duplicate copy of the paper tape prepared in said terminal will be subjected to essentially constant tension notwithstanding the independently operative incremental stepping mechanism which functions to feed the duplicate paper tape through the work area of the validating transaction terminal.

To facilitate an understanding of the present invention it is disclosed in the environment of the validating transaction terminal in conjunction with which it was originally designed to be used.

BRIEF DESCRIPTION OF THE DRAWINGS

Details of the aforementioned features will become more readily apparent upon reference to the following detailed description of the invention wherein specific reference is made to the following figures in which.

DETAILED DESCRIPTION

Figure 1:
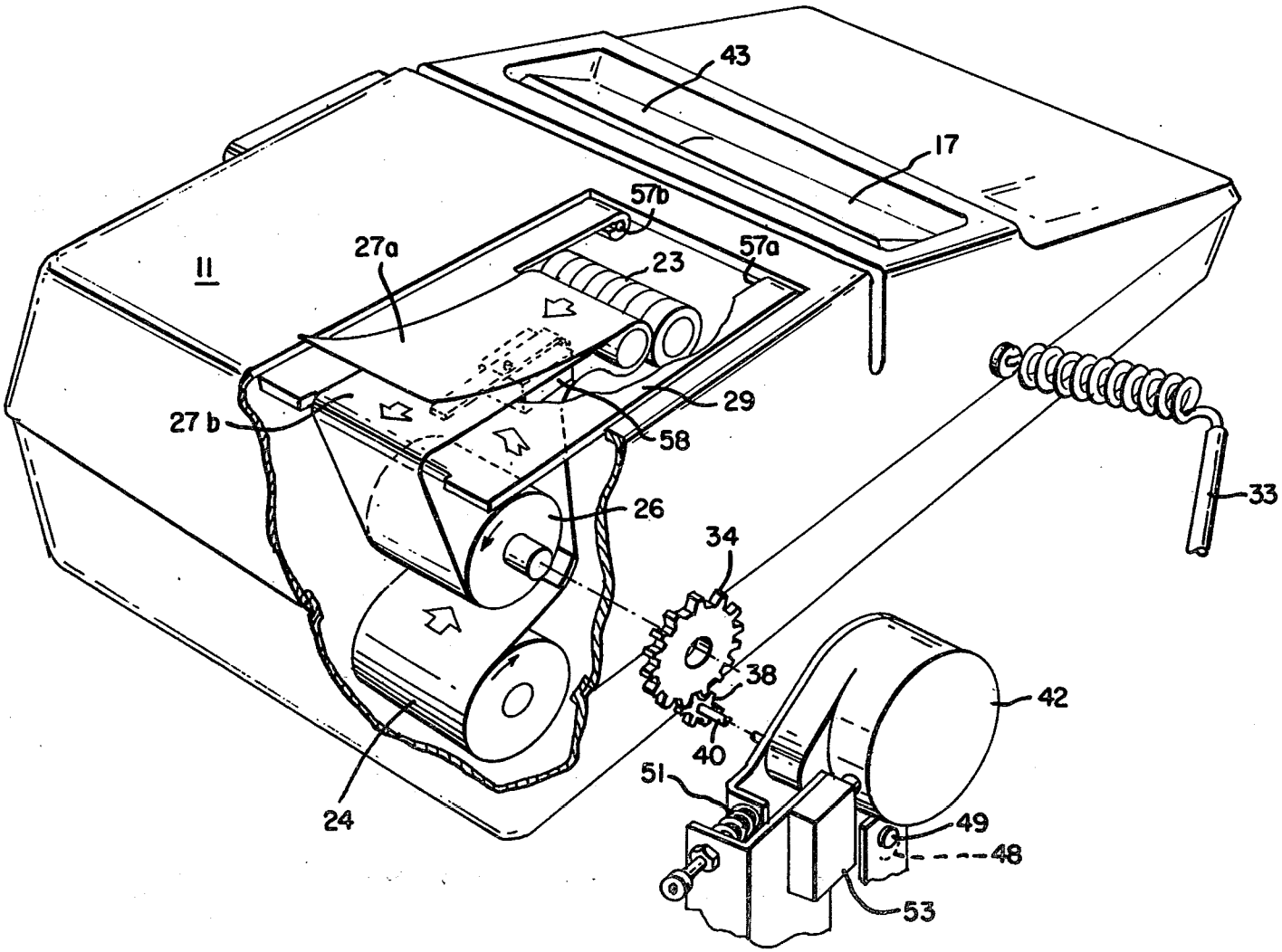
FIG. 1 is a partial exploded view of the auto tensioning mechanism comprising the subject of this present invention depicted in the environment of a terminal device in which it is employed.
Figure 2:
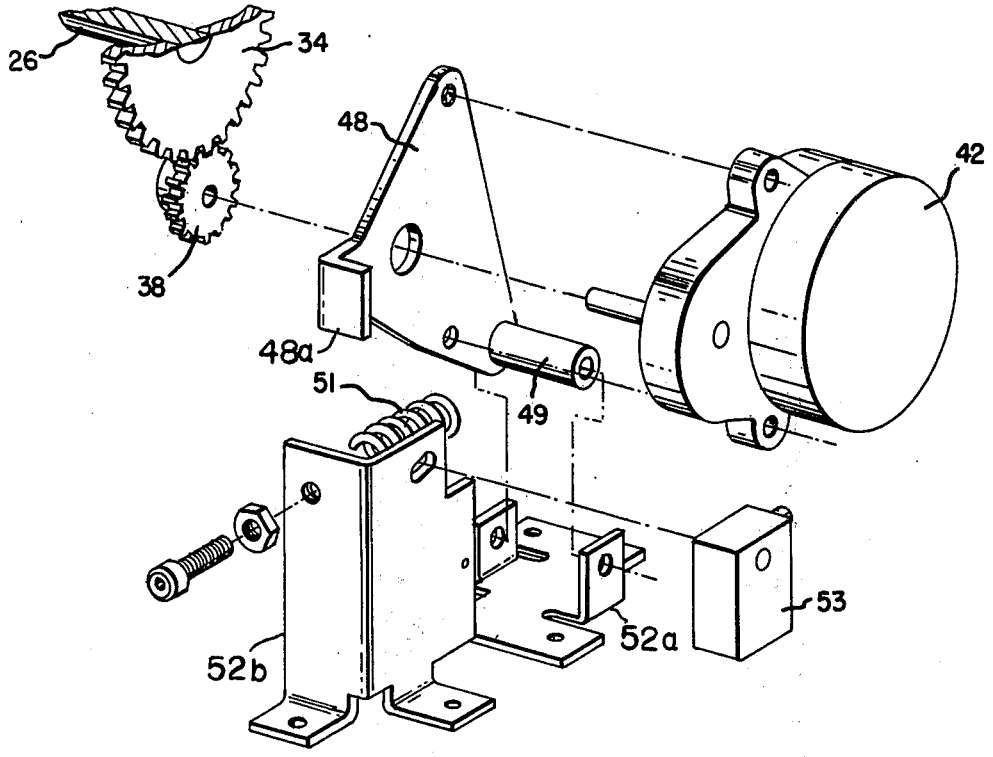
FIG. 2 is an exploded view of the take-up mechanism of FIG. 1.
Figure 3:
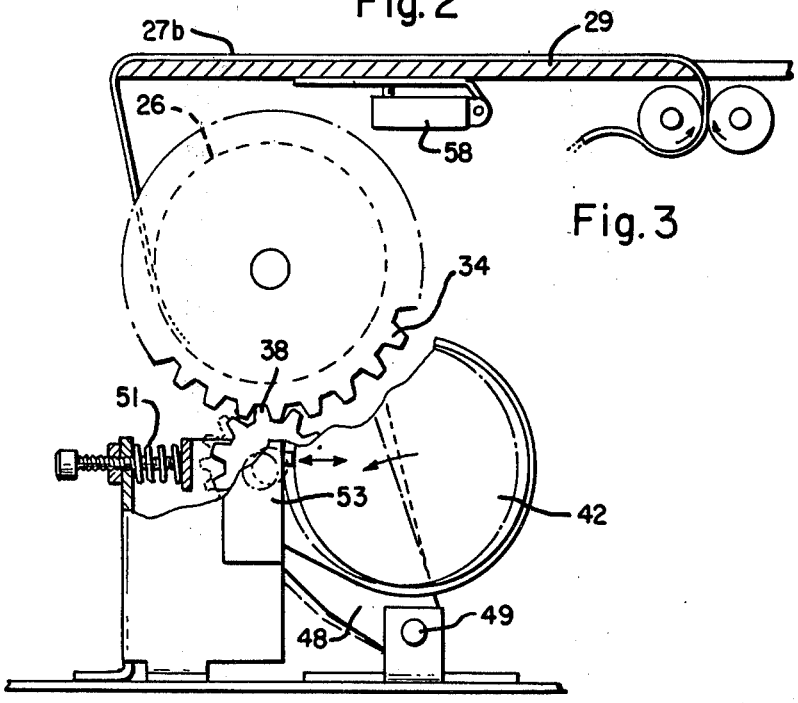
FIG. 3 is an enlarged view of the take-up mechanism of FIG. 1.

Specific details of the automatic tensioning mechanism employed in the paper tape takeup roll are shown in FIGS. 2 and 3. FIG. 1 is a partial-exploded view of the validating transaction terminal wherein is depicted the auto tensioning mechanism which comprises the subject of the present invention. As seen therein, paper tape is fed from a supply roll 24 past the printer 23 and thereafter passes over the signature table 29 before a single copy of the paper tape, 27*b*, is rewound on the takeup roll 26. A driven gear 34 is mounted on the spindle of the take up roll 26. Gear 34 in turn cooperates with a drive gear 38 mounted on a shaft 40 which in turn is rotatively connected to a motor 42 by means of a reducing gear train (not shown) interposed between the shaft 40 and the motor 42. The motor 42 is of conventional design being readily available in a form which includes the reducing gear train interposed between the output of the motor 42 and the shaft 40. The drive assembly, comprising the motor 42 the drive shaft 40 and the drive gear 38, is mounted on a bracket 48 as can be seen more clearly from FIG. 2. The bracket 48 inturn pivots about a point 49, the later being represented as a pivot arm in FIG. 2. The pivot arm 49 in turn rests in a bracket 51*a*.

Operatively positioned with respect to the drive assembly is a further bracket 52*b* which carries thereon an adjustable compression spring 51. Also mounted on the bracket 52*b* is a conventional microswitch 53. Although depicted in FIG. 6A as being separate, the brackets 52*a* and 52*b*, mechanically function as a single member and accordingly the two components depicted therein may be replaced by a single member. The microswitch 53 is of conventional design and functions to control the energization of the motor 42. As such the microswitch is normally "on" whenever paper is being fed to the printer 23. As will become apparent from the explanation which follows, the motor 42, upon cessation of feeding of the paper tape 27 to the printer 23 is carried by the pivotable bracket 48 about the pivot point 49 so that the housing of the motor 42 engages the contact of the microswitch 53 to thereby interrupt the energization current to the motor 42.

It should be noted that the auto tensioning mechanism which is the subject of the present invention does not function to release the paper tape which is, in fact, under the control of the printer 23. Rather, the auto tensioning means functions to maintain an essentially constant tension in the paper tape 27*b* being fed from the work station comprising the printer 23.

During the time that the paper tape is being fed from the printer 23 the torque developed in the motor 42 is sufficient to overcome the frictional drag of the paper tape. Thus, upon release of the paper tape 27*b* by the printer 23, the biasing force of spring 51 pushes the motor housing 42 away from the microswitch 53 initiating operation of the motor 42. Actuation of motor 42 results in a clockwise rotation of the drive gear 38. At this point the tension within the paper tape 27*b* is near zero, such that rotation of the drive gear 38 induces rotation of the driven gear 34. In this manner the take-up roll 26 attached to the driven gear 34 rotates to take up slack in the paper tape 27*b*. During this phase of an operative cycle the motor 42 and its associated pivotable bracket 48 are positioned in the manner depicted by the solid black lines of FIG. 3.

It will be noted that under these conditions the housing of the motor 42 is positioned to provide adequate clearance between it and the microswitch 53 so that the energization current continues to flow to the motor 42. Thus, motor 42 causes the drive gear 38 to continue to rotate the driven gear 34 such that the copy of the paper tape 27*b* continues to be taken up on roll 26 thus insuring proper tension on the paper tape 27*b*.

Whenever the feeding of the paper tape 27*b* through the printer 23 is interrupted the tension in the paper tape 27*b* and thus the resistance offered to the further rotation of the driven gear 34 and associated take-up reel 26 steadily increases until the point is reached where the tension becomes so great that the motor 42 can no longer drive the driven gear 34. At this point in the operative cycle the motor 42 would stall if it were not for the pivotable nature of the motor 42 and its associated bracket 48 about the pivot 49. Because of the restraining effect of the paper tape 27*b* on driven gear 34, the latter appears to the drive assembly comprising the motor 42 and the drive gear 38, as a fixed reference point about which the drive gear 38 can "walk". Thus, the drive assembly comprising the motor 42, the pivotable bracket 48 and the drive gear 38 move toward the position depicted in FIG. 3 in broken lines. In the process the abutting portion 48*a* of the bracket 48 moves against the compressive force being exerted by the spring 51 permitting the housing of the motor 42 to come in contact with and depress the activating arm of the microswitch 53. In this manner the current flow to the motor 42 is interrupted and the auto tensioning mechanism locks up and will remain so until tension in the paper tape 27*b* is relieved. This occurs when the paper tape is once more incremented through the printer 23. The release of tension in the paper tape 27*b* permits the spring 51 to expand thus repositioning the drive assembly to the position depicted in solid black lines in FIG. 3.

It should be noted that the two relatively stable operating positions assumed by the auto tensioning mechanism are each brought about by a balance of the operative forces acting on the system. In this respect during the period that the power to the motor 42 is cut off, the restoring force of the compression spring 51 is offset by the frictional forces comprising the "drag" in the drive assembly as well as by the tension in the paper tape 27*b*. During the period of operation in which the paper tape is being incremented through the printer 23 the compression forces of the spring 51 effects a restorative action on the drive assembly by pivoting the latter out of contact with the microswitch 53.

As will be apparent upon reference to FIG. 3, means are provided in conjunction with the compression spring 51 to vary the torque required to be developed by motor 42 to depress the microswitch 53.

From the foregoing explanation of the operation of the validating transaction terminal in conjunction with which the present invention is intended for use, it should be clear that an auto tensioning mechanism in the nature of that disclosed and claimed herein is applicable to other uses. Accordingly, any modification, variation or equivalent arrangement within the scope of the appended claims should be considered to be within the scope of the invention.

We claim:

1. Automatic tensioning mechanism for a continuous web comprising, drive means, a source of electric power for said drive means, switching means operatively connected to control the flow of electric power to said drive means, a drive gear operatively connected to said drive means, a driven gear operatively connected to be driven by said drive gear, continuous web take up means comprising said driven gear and take up spindel for storing said continuous web, mounting means for pivotably mounting said drive gear with respect to said driven gear, said mounting means further comprising means operative upon pivoting of said drive gear to actuate said switching means, and means external to said automatic tensioning mechanism for controlling the feeding of said continuous web, said drive means being operative to drive said continuous web take up means during the feeding of said continuous web to thereby maintain essentially constant tension in said continuous web and upon termination of feeding of said continuous web said drive means causing a further take up in the slack in said continuous web until the restraining force within said continuous web no longer permits rotation of said driven gear whereupon said drive means continues to drive said pivotably mounted drive gear causing said pivotably mounted drive gear to revolve about the then stationary driven gear thereby causing said mounting means to switch said switching means and to in turn control the flow of electric power to said drive means.

2. Automatic tensioning means for maintaining a continuous web under tension, comprising a power plant for furnishing drive to said automatic tensioning means, a geared drive train comprising a drive gear operatively connected to said power plant to transfer drive from said power plant to said automatic tensioning means, continuous web take up means comprising a driven gear operatively connected to said drive gear of said drive train, means for mounting said power plant and said drive train for translational motion with respect to said continuous web take up means, means for controlling the feed of said continuous web to said continuous web take up means, and means operative with respect to said mounting means to permit the transfer of drive to said drive train from said power plant whenever said continuous web is being fed to said continuous web take up means, whereby, feeding of said continuous web releases restraining forces introduced into said continuous web by said automatic tensioning means, said release causing said biasing means to permit the transfer of drive to said drive train from said power plant which in turn causes said continuous web to be taken up by said continuous web take up means, said continuous web take up means continuing to take up slack in said continuous-web during the balance of feeding of said continuous-web and upon termination of the feeding of said continuous-web said drive train continues to transmit power to said driven gear until the latter can no longer rotate causing said drive gear to revolve about the then stationary driven gear thereby introducing said translational motion to said power plant which in turn causes a disruption in drive to said automatic tensioning means.

3. Automatic tensioning mechanism for maintaining a continuous web under tension, comprising drive means, a geared drive train operatively connected to said drive means, continuous web take up means, said continuous web take up means comprising a driven gear train operatively connected to be driven by said geared drive train, pivoting means for mounting said drive means and said geared drive train, biasing means operatively positioned to exert a restoring force against said pivoting means, switching means responsive to the position of said pivoting means and adapted to control power to said drive means, and means external to said automatic tensioning mechanism for controlling the feed of said continuous web, said drive means being operative to drive said continuous web take up means during the feeding of said continuous web to thereby maintain an essentially constant tension in said continuous web and upon the termination of feeding of said continuous web said drive means being operative to continue to drive said geared drive train causing said geared drive train to walk over the then stationary driven gear train thereby causing said pivoting means to switch said switching means which in turn causes an interruption in power to said drive means.

* * * * *